United States Patent [19]

Schimpf et al.

[11] 4,075,906

[45] Feb. 28, 1978

[54] VARIABLE SPEED GOVERNOR

[75] Inventors: James E. Schimpf, Joliet; Lucien B. Shuler, Peoria, both of Ill.

[73] Assignee: Caterpillar Tractor Co., Peoria, Ill.

[21] Appl. No.: 712,429

[22] Filed: Aug. 6, 1976

[51] Int. Cl.[2] ..... G05G 1/14; G05G 9/08

[52] U.S. Cl. ..... 74/513; 74/474; 74/874

[58] Field of Search ..... 74/474, 482, 512, 513, 74/874

[56] References Cited

U.S. PATENT DOCUMENTS

| | | | |
|---|---|---|---|
| 2,716,397 | 8/1955 | Heinish | 123/99 X |
| 3,014,381 | 12/1961 | Frank | 74/512 |
| 3,130,599 | 4/1964 | Haas | 123/140 R X |
| 3,157,167 | 11/1964 | Walker et al. | 123/103 R |
| 3,199,367 | 8/1965 | Zetye | 74/512 |
| 3,302,763 | 2/1967 | Wobrock | 74/512 X |
| 3,952,512 | 4/1976 | Feller | 74/474 X |

*Primary Examiner*—Allan D. Hermann
*Attorney, Agent, or Firm*—Phillips, Moore, Weissenberger, Lempio & Majestic

[57] ABSTRACT

A speed control system for an internal combustion engine having a variable speed throttle includes an operator input control member connected through suitable linkage to vary the setting of the variable speed governor and includes a balance mechanism having spring means operating in opposition to the reactive forces of the governor for providing a relatively uniform control feel over the range of the operator control member.

5 Claims, 2 Drawing Figures

VARIABLE SPEED GOVERNOR

BACKGROUND OF THE INVENTION

The present invention relates to control means for internal combustion engine and pertains particularly to a governor control linkage for internal combustion engines equipped with variable speed governor.

Many industrial vehicles are powered by engines of the internal combustion piston type. Such internal combustion engines employ mixing and metering devices for metering the fuel to the combustion chambers. The flow of fuel to the combustion chamber frequently determines the speed of the engine. Such metering devices may take the form of injectors or carburetors.

In order to maintain a substantially constant speed of the engine for varying loads, a governor is normally employed which is responsive to engine speed for altering the setting of the fuel flow or mixture to the combustion chambers. Variable speed governors are normally employed in vehicles or engines for vehicles which may undergo frequent adjustment by the operator in the speed of the engine.

The governor setting which determines the engine speed is set by an operator control element movable by the operator to select settings to establish a predetermined setting for the governor. The governor may employ numerous devices such as centrifugal weights or the like wherein the position of the weight is determined by a force acting thereon in addition to the speed of the engine. With such governors the force required for establishing a selected setting increases with increasing engine speed.

Many vehicles such as industrial lift trucks and the like employ implements which require precise and easily controllable manipulation by the operator. It is desirable for this reason that the controls of the vehicle be substantially uniform in feel throughout its control range. This is especially so of the throttle or speed control of the vehicle, especially when precise control of the engine speed is frequently required.

It is therefore desirable that the uneven and excessive force required on the operator control element be eliminated, if possible. Accordingly, the present invention is directed to this end.

While the applicants are not aware of any prior art recognition of this problem or any proposals for solving the problem, the following prior art is of interest in regards to governor control in general: U.S. Pat. Nos. 2,716,397, issued Aug. 30, 1955 to Heinish; U.S. Pat. No. 3,130,599, issued Apr. 28, 1964 to Haas; and U.S. Pat. No. 3,157,167, issued Nov. 17, 1964 to Walker, et al.

SUMMARY AND OBJECTS OF THE INVENTION

A primary object of the present invention is to overcome the above problems of the prior art.

Another object of the present invention is to provide improved control means for a variable governor controlled internal combustion engine.

A further object of the present invention is to provide an operator manipulated linkage control system for controlling governors and including counterbalancing means for substantially evening out and reducing the operator force required over the control range of the system.

In accordance with the primary aspect of the present invention, a control system including an engine variable speed governor for sensing changes in engine speed from a preselected setting and controlling the speed of the engine to correspond to the setting and an operator control element connected to the governor and movable over a control range for varying the control setting of the governor includes balance means connected to the operator control element for acting in opposition to reactive forces of the governor for establishing a substantially constant force for the operator control element over at least a major portion of the control range.

BRIEF DESCRIPTION OF THE DRAWING

The above and other objects and advantages of the present invention may become apparent from the following description when read in conjunction with the drawings wherein.

DETAILED DESCRIPTION

Figure 1:
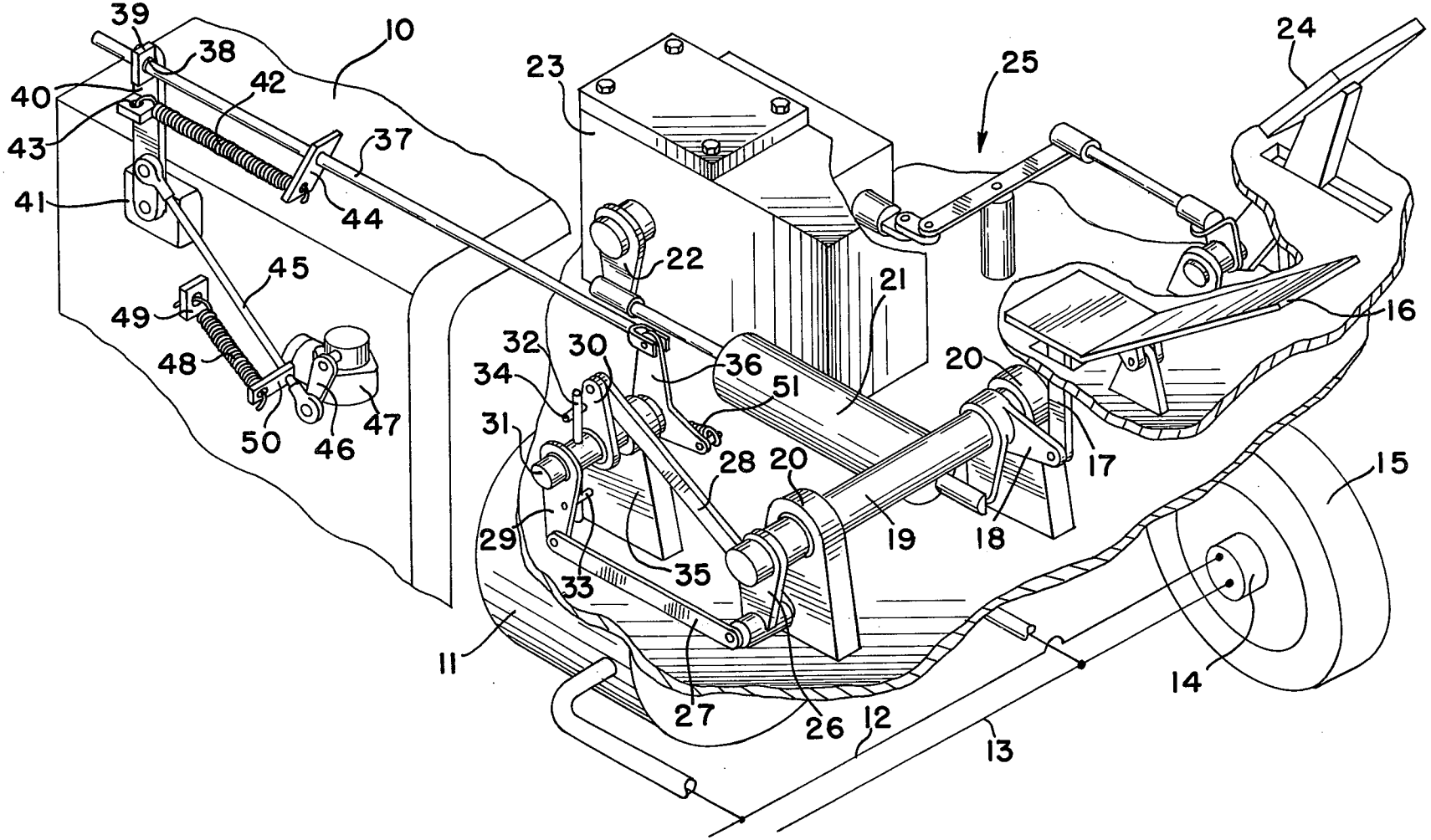
FIG. 1 is a perspective view of a portion of a vehicle including a control system embodying the present invention.

Turning now to FIG. 1 there is illustrated a portion of a vehicle such as a lift truck incorporating the present invention. The vehicle, as illustrated in FIG. 1, includes a prime mover such as an internal combustion engine of the piston type 10 which transmits power by way of a standard transmission of any suitable type compatible with the speed control system of this invention. In the embodiment illustrated, the transmission is of the hydrostatic type comprising a variable displacement pump 11 which transmits power by way of hydraulic fluid in lines 12 and 13 to one or more hydraulic motors 14 which are connected for driving powered wheels 15 of the vehicle. If so desired, the pump and motor could be housed in the same case in a conventional manner.

The velocity and direction of the vehicle is selected by the operator by an operator input means or element such as a rocking foot pedal 16 which is connected by suitable linkage means for simultaneously operating both the displacement of the pump of the hydrostatic transmission and the governor setting for controlling the speed of the internal combustion engine 10. The pedal 16 is pivotally mounted for rocking motion in either direction from a neutral position and connected by a link 17 to an arm 18 of a rotary shaft 19. The shaft 19 is mounted in spaced bearings in brackets 20 for rotary movement in response to rocking movement of the pedal 16. The motion transmitted to the shaft 19 is transmitted by suitable linkage including a link 21 connected to an arm 22 for controlling the position of valve means 23 which controls the displacement of the swash plate (not shown) of standard pump 11.

The arrangement is such that pivotal movement of the pedal 16 in either direction from neutral will result in movement of the swash plate of pump 11 in either direction from its neutral position thereby establishing the direction of movement of the vehicle with the amount of deflection or depression of pedal 16 determining the speed of the vehicle. The link 21 preferably includes a lost motion linkage such that the pedal 16 may be further depressed after full displacement of the transmission control valve is achieved. This pedal 16 is connected by throttle linkage to be described so that further depression of the pedal will increase the engine speed after the transmission has achieved full displacement.

A creeper pedal 24 is connected in a suitable manner through linkage 25 to means such as a vent valve within the valve housing 23 for overriding the control thereof by the pedal 16. This operates to disable the transmission of the vehicle to enable the engine thereof to be revved up to full speed without the transmission operating to thus increase the power available for operating the implements at higher speed.

The foot pedal 16 is connected also to the throttle linkage such that the engine and transmission may be both manipulated by a single foot of the operator.

The engine control linkage includes an arm 26 extending outward from shaft 19 and first and second links 27 and 28 connected to the outer end of arm 26 and respectively to arms 29 and 30 which are rotatably mounted on a rotatable shaft 31. The shaft 31 includes a pin 32 extending therethrough which is normally engagable by one or the other of pins 33 on arm 29 or 34 on arm 30. The shaft 31 is suitably journaled in a bearing on a bracket 35 and includes a bellcrank 36 connected to rotate therewith.

A link or control rod 37 of a throttle control means is pivotally connected to one arm of bellcrank 36 and extends through a bore 38 with a loose fit on a block 39 secured to a governor control arm 40 which is connected in the usual manner to vary the setting of the governor 41. The governor 41 is of a conventional design and responsive to the speed of the engine and to the selected settings of the governor control element or arm 40 as is established by the operator input control element.

Force from the operator control element by way of link 37 is applied to the arm 40 by means of a tension spring 42 connected at one end to a bracket 43 on arm 40 and at the other end to an adjustable bracket 44 on link or rod 37. The bracket 44 may be moved along the rod 37 to adjust the tension in spring 42. The sliding fit of the rod 37 in bore 38 insures that force is transmitted from the rod 37 by way of spring 42 to the governor control arm 40. Thus the governor control arm is free to move in response to governor control as well as the force applied through spring 42. The governor control arm 40 is connected to throttle control means comprising a throttle link 45 pivotally connected to an arm 46 on a carburetor 47 for controlling the throttle valve of the carburetor. Control of the throttle valve controls the flow of fuel or fuel mixture into the engine combustion chambers and thus the speed of the engine. A spring 48 is connected at one end to a stationary bracket 49 and the other end to a bracket 50 on rod 52 for biasing the carburetor control arm 46 toward its minimum speed position.

It will be appreciated that the linkage assembly including links 27–36, forming an operator control input means along with elements 16–19, comprises a one-way linkage of a multi-directional input single-directional output linkage arrangement such that either direction of movement of the operator pedal 16 results in a movement in a single direction of the rod 37 from its zero or neutral displacement position. Thus either direction or movement of the control pedal 16 increases the governor setting of the governor 41 for increasing the engine speed of the engine 10. It will also be appreciated that in view of the spring means 42 and the force necessary to be applied to the governor mechanism that the force requirements of pedal 16 increases as it is displaced from its neutral position.

Figure 2:
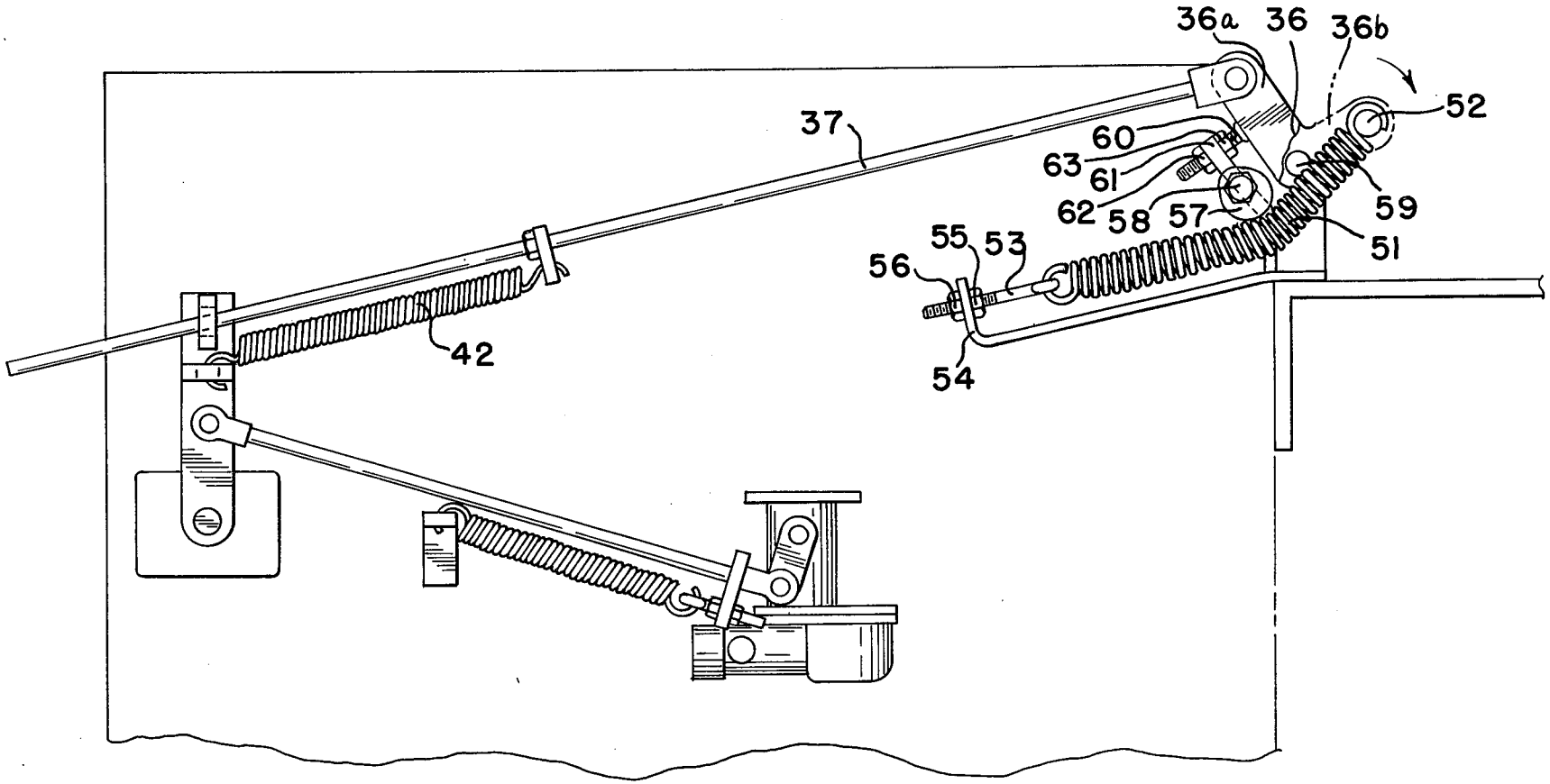
FIG. 2 is a side elevational view of a portion of the control linkage of FIG. 1.

Turning now to FIG. 2, there is illustrated a balance means or mechanism which is designed to partially offset this force increase and to provide a fairly uniform pedal force over the major portion of the control range of the throttle linkage.

The balance mechanism in accordance with the present invention comprises suitable opposing force means comprising a spring 51 of the tension type connected at one end by a pin 52 to the second arm **36*b* of the bellcrank 36. The spring 51 is connected at its opposite end by means of suitable adjusting means such as an eyebolt 53 extending through a bracket 54 which is secured in a stationary manner to a suitable portion of a vehicle. A pair of jam nuts 55 and 56 serve to adjust the eyebolt 53 along its length and likewise to adjust the tension in the spring 51**.

As best seen in FIG. 2, the spring 51 is biased by a fixed cam member 57 which is secured in place and adjustable in its angular position by means of the bolt 58 or the like.

It will be seen that the spring acts on arm **36*b* of the bellcrank 36 in opposition to the opposing force acting on link or arm 36*a* by link 37 by way of spring 42. It will be appreciated that the position of the fixed cam member 57, the pivot axis 59 of bellcrank 36 and the pin position 52 of arm 36*b* will determine the effective moment or torque acting to rotate the bellcrank 36. Thus, the direction of action of the spring 51 on pin 52 can be varied by means of rotation of cam 57. That is especially the direction of action at its neutral position. The neutral position is determined by stop means comprising a screw or the like 60 extending through a bracket 61 with suitable jam nuts 62 and 63 for adjusting the position of the head of the screw or bolt 60. The orientation of the lever/spring assembly at start is thus determined by the setting of this stop means for abutment by arm 36*a* of the bellcrank 36**.

It will be appreciated that when the bellcrank 36 rotates in clockwise direction, the moment arm between pivot pin 59 and pin 52 increases while at the same time the tension in spring 51 decreases so that the increase in moment arm compensates for the decrease in force or tension in spring 51. The action of this mechanism is such as to oppose the reactive forces on link 37 by the governor control arm 40 so that these forces are somewhat balanced over the range of movement of the control pedal or the major portion of the range of movement of control pedal 16. It will be appreciated of course that a certain amount of bias will be needed to return the linkage to the neutral or zero position. With the present invention, however, the amount of force necessary to move the linkage or governor control from its neutral position to its maximum position will be somewhat uniform over at least a major portion of the range of movement. This gives the operator of the vehicle a much better feel of the vehicle such that the engine speed and transmission displacement can be more precisely and effortlessly controlled.

While the present invention has been described and illustrated by means of a preferred embodiment, it is to be understood that numerous changes and modifications may be made therein without departing from the spirit and scope of the invention as defined in the appended claims.

What is claimed is:

1. A control system including in combination an engine variable speed governor for sensing changes in engine speed from a preselected setting and controlling the speed of the engine to correspond to said setting;

operator control input means connected to said governor and movable over a control range for varying the control setting of said governor; and balance means connected to said operator control input means for acting in opposition to reactive forces of said governor against said operator control input means for establishing a substantially constant force for said operator control input means over a major portion of said control range comprising spring means acting in opposition to said reactive forces and cam means engaging said spring means and altering the normal variations in tension of said spring over its normal range of displacement.

2. The control system of claim 1 wherein said operator control input means comprises linkage means for selectively preloading a spring connected to said governor for establishing said preselected settings.

3. The control system of claim 1 wherein said spring means comprises a tension spring; and tension adjusting means for adjusting the tension in said tension spring.

4. The control system of claim 1 wherein said operator control input means comprises a rocking foor pedal mounted for rocking movement in either direction from a neutral position, linkage means connecting said foot pedal to a governor control element of said governor, and means for moving said governor control element in a single direction from a neutral position upon movement of said foot pedal in either direction from its neutral position.

5. A control system in combination with a control means for an engine comprising operator control input means including a pivoted bellcrank having first and second arms, spring means connected between said control means and the first arm of said bellcrank for biasing said bellcrank in a first pivoted direction, and balance means, comprising a tension spring and cam means engaging said tension spring for applying a force thereagainst, connected to the second arm of said bellcrank for biasing said bellcrank in a second pivoted direction opposite to said first pivoted direction against and in balancing relationship with respect to the biasing force of said spring means.

* * * * *